US008342869B2

(12) United States Patent
Okamura

(10) Patent No.: US 8,342,869 B2
(45) Date of Patent: Jan. 1, 2013

(54) ELECTRICAL CONNECTOR HAVING TERMINAL GROOVES WITH VARIOUS WIDTHS

(75) Inventor: Seiji Okamura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 63 days.

(21) Appl. No.: 13/016,167

(22) Filed: Jan. 28, 2011

(65) Prior Publication Data

US 2011/0189896 A1 Aug. 4, 2011

(30) Foreign Application Priority Data

Feb. 3, 2010 (JP) ..... 2010-022086

(51) Int. Cl.
*H01R 13/15* (2006.01)

(52) U.S. Cl. ..... 439/260

(58) Field of Classification Search ..... 439/260, 439/495, 625, 629
See application file for complete search history.

(56) References Cited

U.S. PATENT DOCUMENTS 5,580,272 A * 12/1996 Yamaguchi et al. ..... 439/495
5,785,549 A * 7/1998 Takayasu ..... 439/495
5,904,586 A * 5/1999 Takayasu ..... 439/260
6,116,947 A * 9/2000 Takayasu ..... 439/495
7,172,445 B2 * 2/2007 Shimoyama ..... 439/260
7,661,972 B2 * 2/2010 Okamura et al. ..... 439/260
7,736,164 B2 * 6/2010 Okamura ..... 439/260
2002/0028605 A1 * 3/2002 Takayasu ..... 439/625

FOREIGN PATENT DOCUMENTS

JP 08-195256 7/1996

* cited by examiner

*Primary Examiner* — Chandrika Prasad
(74) *Attorney, Agent, or Firm* — Kubotera & Associates, LLC

(57) ABSTRACT

A circuit board electrical connector to be disposed on a circuit board includes a housing and a plurality of terminals arranged in the housing. The housing includes a receiving space with an upper opening portion to receive a flat conductive member and a housing space with a lower opening portion that communicates with the receiving space. Each of the terminals has a connecting section and a contact section. The circuit board electrical connector has a portion to house a middle section of the terminal between the connecting section and the contact section. The portion is a region includes a range that overlaps at least with the upper opening portion and lower opening portion when viewed from an upper side, and is made wider at a gap between an inner surface of the housing space and the terminal than a gap other than the region.

5 Claims, 6 Drawing Sheets

ELECTRICAL CONNECTOR HAVING TERMINAL GROOVES WITH VARIOUS WIDTHS

BACKGROUND TECHNOLOGY AND RELATED TECHNOLOGY

The present invention relates to an electrical connector. More specifically, the present invention relates to a circuit board electrical connector to be mounted on a circuit board.

Patent Reference has disclosed a conventional electrical connector or a conventional circuit board electrical connector. The conventional circuit board electrical connector is disposed on a circuit board for receiving a flat conductive member (flexible substrate) from above, so that the circuit board is connected to the flat conductive member. The electrical connector disclosed in Patent Reference includes a housing which has an upper opening portion and a lower opening portion formed therein, a plurality of terminals (contacts) that is arranged and held in the housing, and a pressing member that is rotatably held by the housing and the terminals.

Patent Reference: Japanese Patent Publication No. 08-195256

In the conventional electrical connector described in Patent Reference, the housing includes a receiving groove to receive the flat conductive member through the upper opening portion and a housing groove (a holding groove) to house the terminals through the lower opening portion. The receiving groove and the housing groove are formed in the housing and communicate to each other.

In the conventional electrical connector described in Patent Reference, the terminals are made by punching a sheet metal while a flat plate surface is maintained. Each of the terminals includes an arm portion, and the arm portion extends upward while curving and has a contact section formed at an upper end portion thereof. Each of the terminals further includes a connecting section that extends laterally from a lower end of a basal part of the arm portion.

In the conventional electrical connector described in Patent Reference, when the terminal is held in the housing groove, the arm portion of the terminal extends vertically in the receiving groove of the housing, and the contact section of the arm portion is situated near the upper opening portion so as to contact with the flat conductive member inserted in the receiving groove. Furthermore, the connecting section extends outside the housing so as to connect to a corresponding circuit unit of the circuit board with solder.

In the conventional electrical connector disclosed in Patent Reference, the housing groove of the housing to house the terminals is often formed in a slit shape having substantially the same width as a plate thickness of the terminals. There is no specific description about a dimension of the housing groove in Patent Reference. Accordingly, it may be considered that the housing groove may be formed as the slit having substantially the same widths as the plate thicknesses of the terminals, and there is hardly any gap between the terminals in the plate thickness direction.

When the housing groove is formed as the slit, and the terminal is housed in the housing groove, the lower opening portion of the housing is fully occupied with the terminals. Therefore, when a dust, i.e., a foreign matter, falls in the housing through the upper opening portion, the dust may be accumulated in the receiving groove and the housing groove and stick to the terminals. When the dust sticks to the terminals, there may be a problem such as short circuit between adjacent terminals. In addition, there is also a concern of poor connection between the terminals and the flat conductive member due to the dust attached to contact sections of the terminals.

Moreover, when the connecting sections are connected to the corresponding circuit unit on the circuit board with solder, solder and flux may crawl up through a capillary phenomenon between the housing groove and the plate surfaces of the terminals. As a result, there is a concern of poor connection between the terminals and the flat conductive member due to solder and flux reaching up to the contact sections of the terminals.

In view of the problems described above, an object of the present invention is to provide a circuit board electrical connector, which can prevent a dust from being accumulated in the electrical connector. Accordingly, the electrical connector does not have a problem such as short circuit between terminals and poor contact between the terminals and a flat conductive member. Further, it is possible to preventing solder and the flux from crawling up to connecting sections of the terminal, thereby preventing poor contact between the terminals and the flat conductive member.

Further objects and advantages of the invention will be apparent from the following description of the invention.

SUMMARY OF THE INVENTION

In order to attain the objects described above, according to the present invention, an electrical connector to be disposed on a circuit board includes a housing and a plurality of terminals arranged and held in the housing. The housing includes a receiving space that has an upper opening portion to receive a flat conductive member that is inserted to the receiving space from above. The housing further includes a housing space that communicates with the receiving space. The housing space has a lower opening portion, so that the terminals are received in the housing space from the lower opening portion.

According to the present invention, each of the terminals has a connecting section to be connected onto the circuit board on a side of the lower opening portion at one end portion thereof, and a contact section to contact with the flat conductive member received in the receiving space at the other end portion thereof.

According to the present invention, the circuit board electrical connector has a portion in the housing space to house a middle section of the terminal between the connecting section and the contact section. The portion is a region includes a range that overlaps at least with the upper opening portion and lower opening portion when viewed from an upper side, and is made wider at a gap between an inner surface of the housing space and the terminal than a gap other than the region.

According to the present invention, in the housing space, a gap is formed vertically from the terminal in a plate thickness direction of the terminal in the portion between the upper opening portion and the lower opening portion to house the middle section between the connecting sections and the contact sections of the terminal. Accordingly, even if a dust falls and enters from the upper opening portion, the dust is discharged outside from the lower opening portion through the gap, so that the dust does not deposit in the receiving space and the housing space. As a result, the dust does not adhere to the terminals, thereby preventing a problem such as short circuit between adjacent terminals. In addition, since the dust does not adhere to the contact sections of the terminals, poor contact between the terminals and the flat conductive member does not occur.

According to the present invention, there is the gap formed from the terminal in the housing space. Accordingly, a capillary phenomenon does not take place in the gap. Therefore, solder and flux that crawl up from the connecting section side do not further move from the gap toward the contact section. As a result, the solder and flux does not adhere to the contact sections of the terminals, and there is no poor contact between the terminals and the flat conductive member.

According to the present invention, the electrical connector further includes a pressing member that can pivotally move between an open position to enable insertion of a flat conductive member into the receiving space of the housing and a close position to press the flat conductive member against the contact sections of the terminals. The pressing member has a pressing section that is provided within the receiving space at the close position and presses the flat conductive member against the contact sections of the terminals.

Preferably, the pressing section has a communicating groove that is provided vertically therethrough at the close position. Accordingly, the receiving space can connect to the housing space, and dust, which falls therein from the upper opening portion, can be discharged from the lower opening portion through the groove.

According to the present invention, when the pressing member is at the close position, the pressing section of the pressing member is in the receiving space. The pressing section has the communicating groove that is vertically open therethrough at the close position. Accordingly, the receiving space and the housing space connect to each other. With the communicating groove, dust fell therein from the upper opening portion falls and then is discharged from the lower opening portion through the space. As a result, dust does not adhere to the terminals, and it is possible to satisfactorily prevent a problem such as a short circuit between adjacent terminals. In addition, it is possible to satisfactorily prevent poor contact between the terminals and the flat conductive member due to adhesion of the dust to the contact sections of the terminals.

As described above, according to the present invention, in the housing space, there is the gap vertically formed in the portion to house the middle section of the terminal between the connecting section and the contact section, which is between the upper opening portion and the lower opening portion. Accordingly, dust fell into the receiving space falls and is discharged outside from the lower opening portion through the gap.

Therefore, dust does not deposit in the receiving space and in the housing space, and dust does not adhere to the terminals. Accordingly it is possible to prevent a problem such as a short circuit between the adjacent terminals. In addition, it is also possible to satisfactorily prevent poor contact between the terminals and the flat conductive member due to adhesion of dust to the contact sections of the terminals.

Furthermore, according to the present invention, there is the gap formed from the terminal in the housing space. Accordingly, a capillary phenomenon does not occur. Further, solder and flux, which crawl up from the connecting section side during soldering to connect between the connecting sections and corresponding circuit sections of a circuit board, does not further move from the gap toward the contact section. Therefore, solder and flux does not reach the contact sections of the terminals, and it is possible to prevent poor contact between the terminals and the flat conductive member.

BRIEF DESCRIPTION OF THE DRAWINGS

FIGS. 3(A) and 3(B) are longitudinal sectional views showing the circuit board electrical connector before the flat conductive member is inserted into the circuit board electrical connector according to the embodiment of the present invention, wherein FIG. 3(A) is a sectional view of the circuit board electrical connector taken along a line IIIA-IIIA in FIG. 1 and FIG. 3(B) is a sectional view of the circuit board electrical connector taken along a line IIIB-IIIB in FIG. 1;

FIGS. 5(A) and 5(B) are views showing the circuit board electrical connector according to the embodiment of the present invention, wherein FIG. 5(A) is a bottom view of the circuit board electrical connector and 5(B) is a sectional view of the circuit board electrical taken along a line VB-VB in FIG. 3(B); and FIGS. 6(A) and 6(B) are longitudinal sectional views showing the circuit board electrical connector after the flat conductive member is inserted into the circuit board electrical connector according to the embodiment of the present invention, wherein FIG. 6(A) is a sectional view of the circuit board electrical connector corresponding to FIG. 3(A) and FIG. 6(B) is a sectional view of the circuit board electrical connector corresponding to FIG. 3(B).

DETAILED DESCRIPTION OF THE PREFERRED EMBODIMENTS

Hereunder, embodiments of the present invention will be described with reference to the accompanying drawings.

Figure 1:
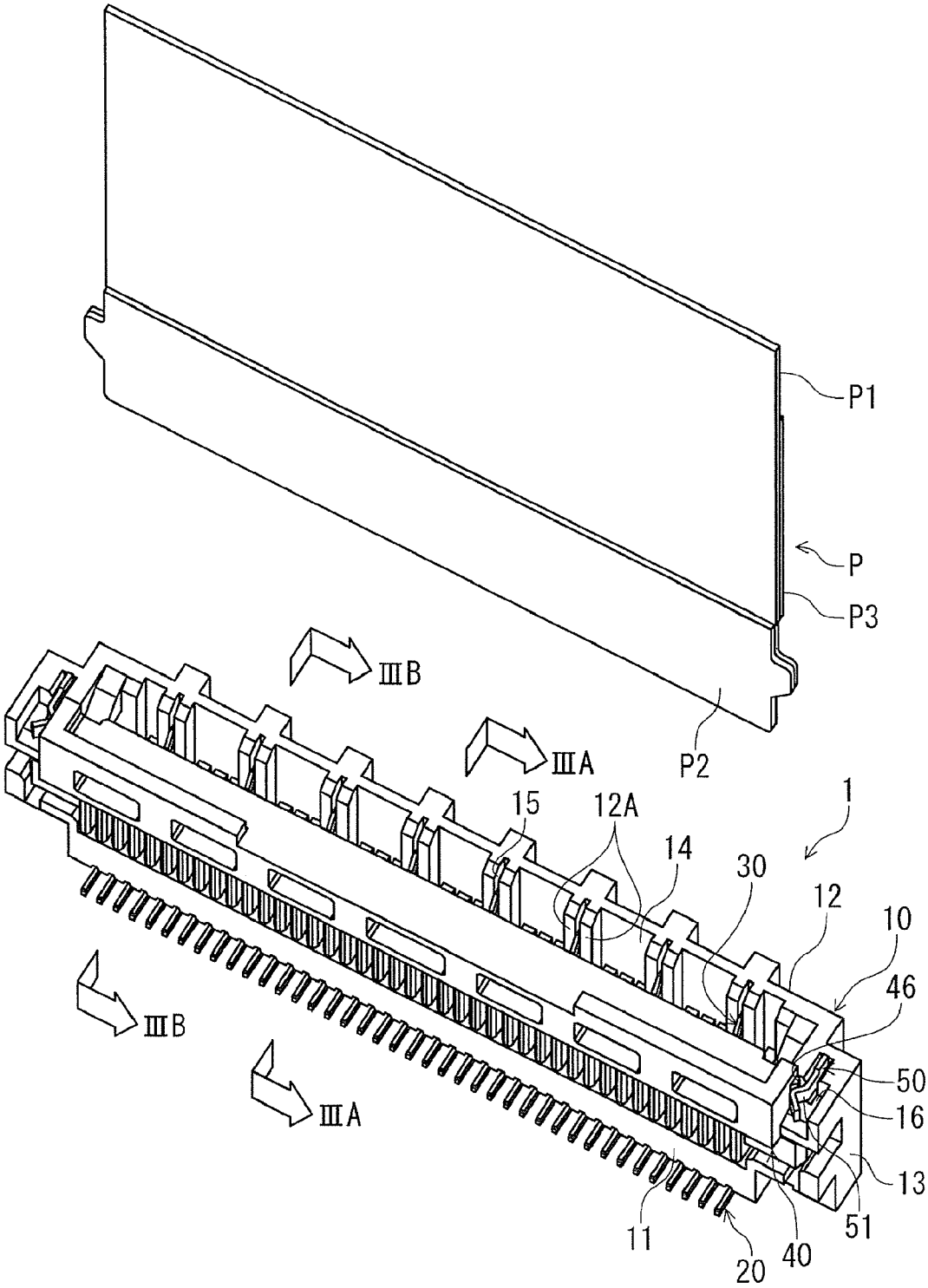
FIG. 1 is a perspective view showing a circuit board electrical connector and a flat conductive member before the flat conductive member is inserted into the circuit board electrical connector in a state that a pressing member is situated at an open position according to an embodiment of the present invention.
Figure 2:
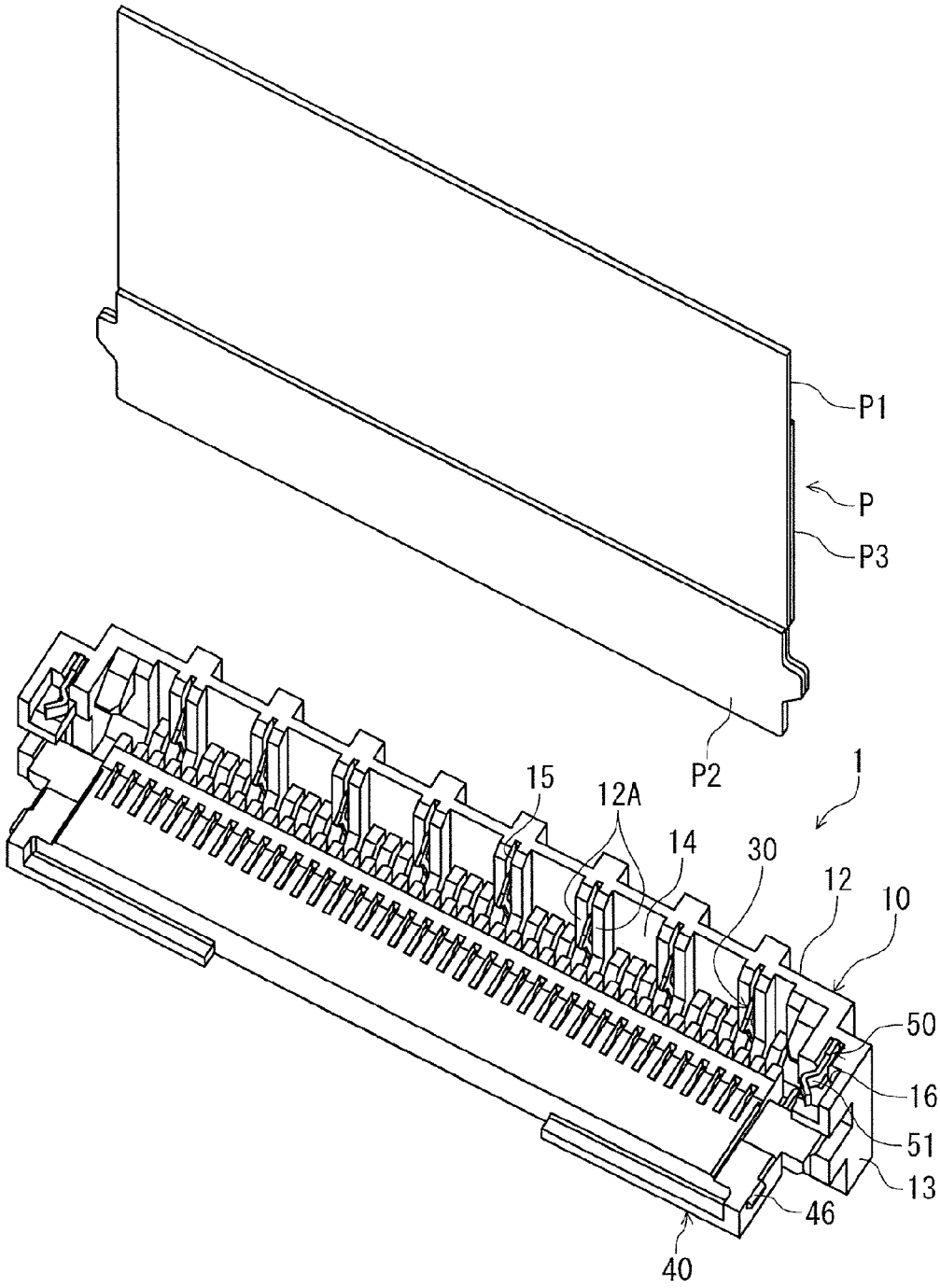
FIG. 2 is a perspective view showing the circuit board electrical connector and the flat conductive member before the flat conductive member is inserted into the circuit board electrical connector in a state the pressing member is situated at a close position according to the embodiment of the present invention.

FIG. 1 is a perspective view of a circuit board electrical connector 1 and a flat conductive member before insertion of the flat conductive member P according to an embodiment of the present invention, in which a pressing member 40 is in an open state. FIG. 2 is a perspective view of the circuit board electrical connector 1 shown in FIG. 1 and the flat conductive member P before an insertion of the flat conductive member P, in which the pressing member 40 is in a close position.

In the embodiment of the present invention, the circuit board electrical connector 1 (hereinafter simply referred to as the connector 1) is an electrical connector to be disposed on a circuit board (not illustrated), and receives the flat conductive member P from above and then connects to the flat conductive member P.

As shown in FIG. 1, one surface of a main body P1 of the flat conductive member P has a reinforcing plate P2 attached onto a lower end portion. On the other surface of the main body P1, connection pads (not illustrated) of a signal circuit section to be connected to first terminals 20, which will be described later, are exposed at the lower end portion, and the connection pads are formed being arranged in the width direction of the flat conductive member P. A ground bar P3 as a ground circuit section to be connected to second terminals 30, which will be described later, is attached across the whole width direction at a position near the lower end part of the main body P1 but above the signal circuit section.

In other words, in the flat conductive member P, the signal circuit section that corresponds to the first terminals 20 and the ground bar P3 that corresponds to the second terminals 30 are formed in two layers along the thickness direction of the flat conductive member P. In addition, the connection pad portion of the signal circuit section is disposed below the ground bar P3 while extending over the same width position of the flat conductive member P on the other surface of the flat conductive member P.

In the embodiment of the present invention, the connector 1 includes a housing 10, which has an outer shape of a generally rectangular solid and receives the flat conductive member P from above, first terminals 20, which are arranged and held as signal terminals at the equal intervals in the longitudinal direction of the housing 10 (the terminal arrangement direction that is horizontal to a circuit board surface), second terminals 30 as ground terminals, a pressing member 40 that can freely pivotally move between the open position shown in FIG. 1 and the close position shown in FIG. 2, and a locking hardware 50 to hold the pressing member 40 attached onto the housing 10 at the open position.

The housing 10 includes a sidewall 11 and a sidewall 12, which extend vertically from a surface of the circuit board and are parallel to each other in the longitudinal direction, and two end walls 13 that respectively join the ends of the sidewall 11 and the sidewall 12. The space, which is formed by the sidewalls 11 and 12 and the end walls 13 and is opened upward, is formed as a receiving groove 14, which is receiving space to receive the flat conductive member P from above.

As will be described later, the first terminals 20 are arranged along and held by the sidewall 11, and the second terminals 30 are arranged along and held by the sidewall 12. As shown in FIG. 1, there are provided less number of the second terminals 30 than the first terminal 20, and the second terminals 30 are provided in positions corresponding to a part of the plurality of the first terminals 20 in the terminal arrangement direction. Accordingly, in the embodiment, since the second terminals 30 are held at the same positions as the first terminals 20 in the terminal arrangement direction, it is possible to electrically connect to the circuit sections that are arranged at tight pitches in the width direction in the flat conductive member P.

As well shown in FIGS. 1 and 2, the sidewall 12 has pairs of protruding strips 12A, which vertical extend, at positions where the second terminals 30 are respectively held along the lateral direction, i.e. terminal arrangement direction, so as to protrude from an inner wall surface of the sidewall 12 toward inside of the receiving groove 14. As will be described later, the groove between each pair of the protruding strips 12A composes a part of the receiving groove 15 to hold a part of the first terminals 20 and the second terminals 30.

As can be seen in FIGS. 1 and 2, each end wall 13 has a recess 16 to house and hold the locking hardware 50, being opened upward, and has a locking hardware attachment hole (not illustrated), which is formed therethrough in the vertical direction, on a bottom portion of the recess 16. The recess 16 is made wider in the terminal arrangement direction near the sidewall 11 where the sidewalls 11 face each other, and allows elastic displacement of the locking hardware 50 at the wider portion.

Figure 3B:
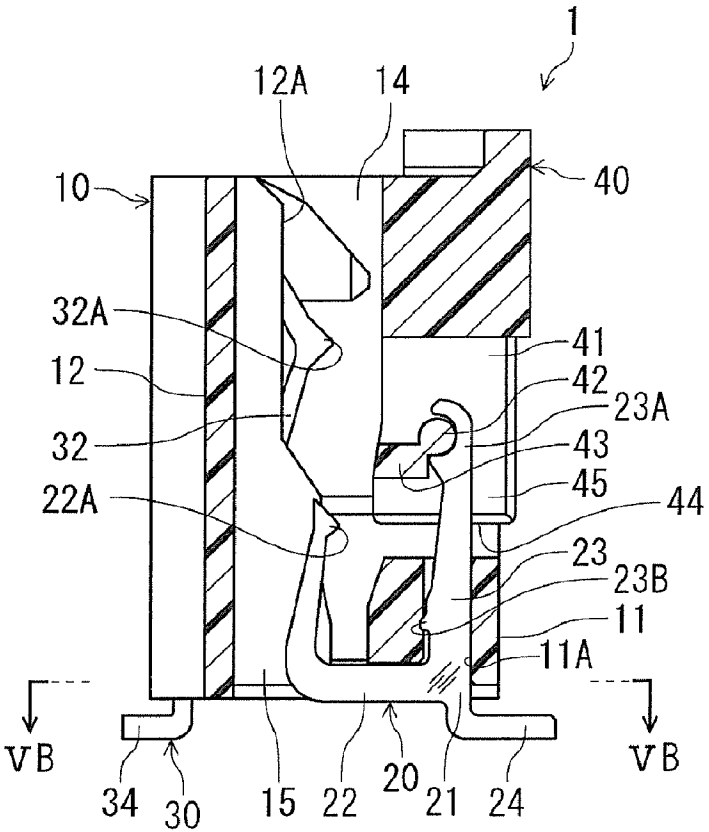
Figure 3A:
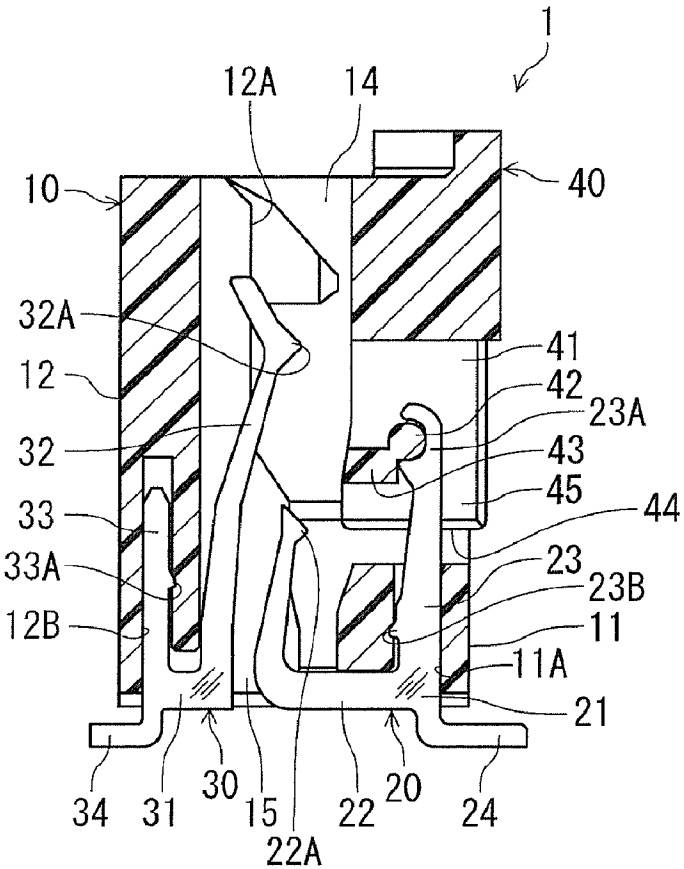

FIGS. 3(A) and 3(B) are longitudinal sectional views showing the circuit board electrical connector 1 before the flat conductive member P is inserted into the circuit board electrical connector 1 according to the embodiment of the present invention. FIG. 3(A) is a sectional view of the circuit board electrical connector 1 taken along a line IIIA-IIIA in FIG. 1. FIG. 3(B) is a sectional view of the circuit board electrical connector 1 taken along a line IIIB-IIIB in FIG. 1.

More specifically, FIG. 3(A) shows a section which includes both first terminal 20 and second terminal 30 that are respectively arranged in the terminal arrangement directions. FIG. 3(B) shows a section, which includes only the first terminal 20 that is arranged in the terminal arrangement direction.

As shown in FIGS. 3(A) and 3(B), as for the sidewall 11 and the sidewall 12 that face each other, one sidewall 11 has a smaller height than the other sidewall 12. The sidewall 11 includes attachment holes 11A, which are provided therethrough in the vertical direction to attach the first terminals 20. In addition, as shown in FIG. 3(A), the sidewall 12 has attachment holes 12B, which are opened downward to attach the second terminals 30.

Figure 4:
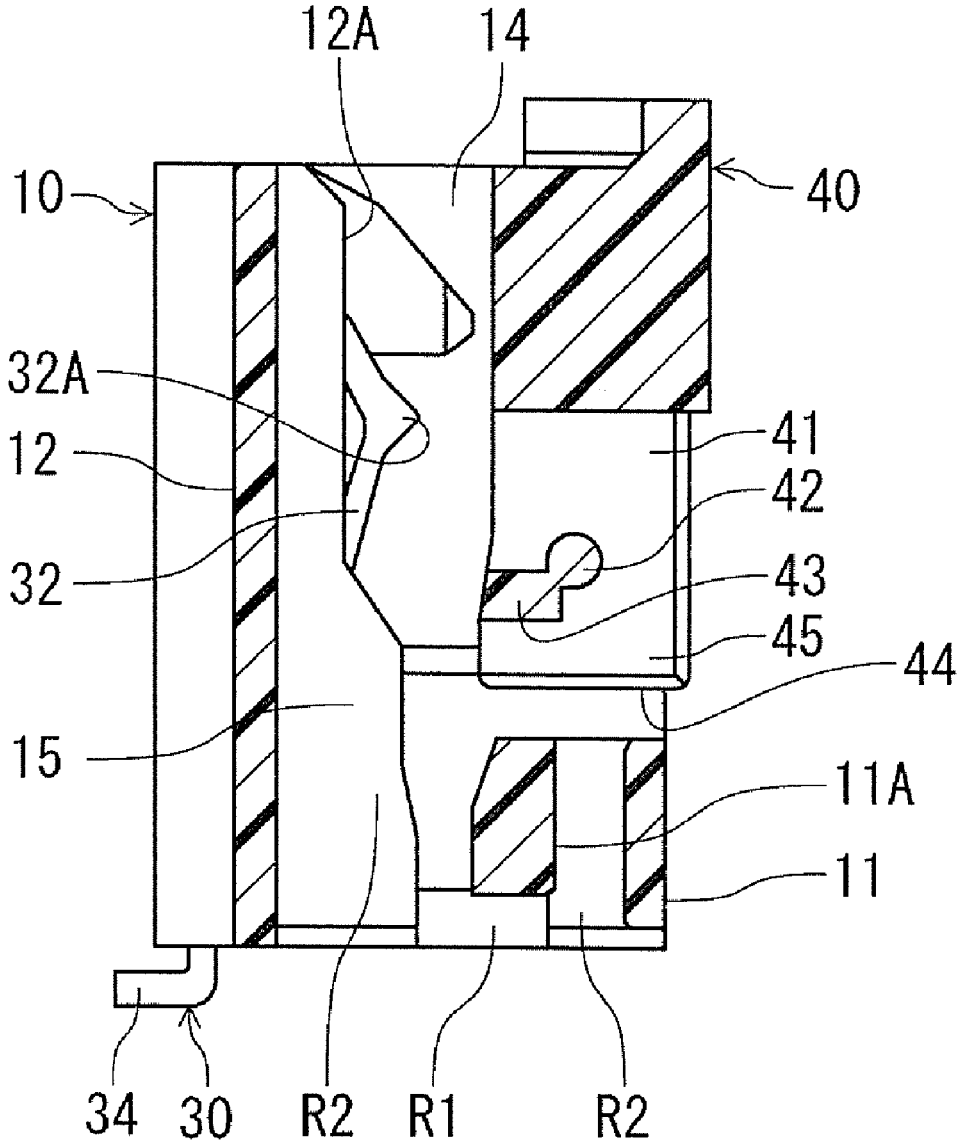
FIG. 4 is a sectional view of the circuit board electrical connector corresponding to FIG. 3(B) in a state that first terminals and second terminals is omitted according to the embodiment of the present invention.

In the embodiment of the present invention, the housing 10 vertically extends along the inner wall surface of the sidewall 12 and has a housing groove 15, which is provided so as to face the sidewalls 11 and 12, as housing space to house the first terminals 20 and the second terminals 30 (see also FIG. 4). More specifically, the housing groove 15 extends in the vertical direction from an upper end of the housing 10 to a the lower end, and extends in the facing directions from the inner wall surface of the sidewall 12 to under the attachment hole 11A of the sidewall 11, so as to have a generally L-shape as a whole (see also FIG. 4).

The housing groove 15 communicates with the receiving groove 14 and has a lower opening, and houses the first terminals 20 and the second terminals 30 from the lower opening. The lower opening communicates to the attachment holes 11A and 12B. The groove width of the housing groove 15, i.e. the dimension in a direction orthogonal to the paper surface, will be described later.

Each of the first terminals 20 is made by punching sheet metal while keeping its plate surface. As shown in FIGS. 3(A) and 3(B), each first terminal 20 includes a flexible first elastic arm portion 22, which extends leftward and then upward and has a generally L-shape, a straight support arm portion 23, which extends upward from a basal section 21 of the first elastic arm portion 22, and a first connecting section 24, which extends downward from the basal section 21, then rightward and extends outside the housing 10 forming a crank-shape. It is noted that the first connecting section 24 of the first terminal 20 extends outside the sidewall 11 (the right side in FIGS. 3(A) and 3(B)).

In the embodiment of the present invention, the first elastic arm portion 22 comprises a generally horizontal part, which extends leftward from the basal section 21, and a generally vertical part, which extends upward from the left end of the generally horizontal part, which is closer to the sidewall 12 than the receiving groove 14. The first elastic arm portion 22 has, at its upper end of the vertical part, a first contact section 22A for elastically contacting with the signal circuit section of the flat conductive member P, so as to protrude inside the receiving groove 14 toward the inserted flat conductive member P (see also FIGS. 6(A) and 6(B)).

The support arm portion 23 includes at its upper end part a rotary support section 23A, which is opened leftward to be a round concave shape. As will be described, the rotary support section 23A freely rotatably supports the rotary shaft 42 of the pressing member 40. The support arm portion 23 has a pressing protrusion 23B formed to protrude from the left edge at a relatively lower position thereof. The first connecting section 24 is provided lower than the bottom portion of the housing 10, and a lower edge of a portion that extends rightward is designed to be connected by soldering to the signal circuit section (not illustrated) on the circuit board.

Once the support arm portion 23 is pressed into the attachment hole 11A of the sidewall 11 of the housing 10 from thereunder, the pressing protrusion 23B of the support arm portion 23 latches onto the inner wall surface of the attachment hole 11A and thereby the first terminal 20 is held by the sidewall 11 near the bottom portion of the housing 10.

In addition, with the first terminal 20 being held by the sidewall 11, the support arm portion 23 penetrates through the attachment hole 11A and the upper half portion extends upward from the attachment hole 11A. Moreover, as shown in FIGS. 3(A) and 3(B), the first elastic arm portion 22 has its most part housed in the housing groove 15, and the first contact section 22A sticks out from the housing groove 15 to the receiving groove 14.

Similarly to the first terminals 20, each second terminal 30 is made by punching sheet metal keeping the plate surface. As shown in FIG. 3(A), each second terminal 30 includes a second elastic arm portion 32, which extends upward, a straight attachment arm 33, which extends upward from a left part of the basal section 31 of the second elastic arm portion 32, and a second connecting section 34, which extends downward from the left part of the basal section 31 and then extends leftward so as to have a crank-like shape to extend outside the housing 10. It is noted that the second connecting section 34 of the second terminal 30 extends outside the sidewall 12 (the left side in FIGS. 3(A) and 3(B)).

As well shown in FIG. 3(A), the second elastic arm portion 32 extends tilting to the middle position so as to be gradually away from the sidewall 12 as it goes upward, and then extends being tilted from the bent part near the upper end of the second elastic arm portion 32 so as to approach the sidewall 12 as it goes upward. At the bent part of the second elastic arm portion 32, there is provided a second contact section 32A for elastically contacting with the ground bar P3 of the flat conductive member P, which protrudes into the receiving groove 14 so as to contact with the inserted flat conductive member P (see also FIGS. 6(A) and 6(B)).

In the embodiment of the present invention, the attachment arm 33 has a pressing protrusion 33A, which vertically protrudes at a generally center position on the right edge. The second connecting section 34 is provided lower than the bottom portion of the housing 10 and is designed to have the lower end part of the part extending leftward be connected by soldering to a ground circuit section (not illustrated) on the circuit board.

The attachment arm 33 is pressed into the attachment hole 12B of the sidewall 12 of the housing 10 from below, and the pressing protrusion 33A of the attachment arm 33 latches onto the inner wall surface of the attachment hole 12B, and thereby the second terminal 30 becomes held by the sidewall 12 near the bottom portion of the housing 10. The second elastic arm portion 32 has its most part housed in the housing groove 15, and the second contact section 32A protrudes from the housing groove 15 into the receiving groove 14.

As shown in FIG. 3(A), being closer to the sidewall 12 than the first elastic arm portion 22 of the first terminal 20, the second elastic arm portion 32 extends higher than the upper end of the first elastic arm portion 22 from the bottom portion of the housing 10. Moreover, the second contact section 32A of the second elastic arm portion 32 is provided higher than the first contact section 22A of the first elastic arm portion 22.

In the embodiment of the present invention, the second terminal 30 is attached to the sidewall 12 from below, and the second elastic arm portion 32 of the second terminal 30 extends upward in the housing groove 15. In other words, being different from ground members that extend along an outer surface of the sidewall of the housing and are curved being folded back across the upper end as in a conventional one, since the second terminal 30 does not have the curved section that is provided over the upper end of the sidewall 12, it is possible to reduce the height dimension of the second terminal 30.

Even in the housing 10, since it is not necessary to form a recess to house the curved section of the ground member as in a conventional one, it is possible to reduce the height dimension of the housing 10. Furthermore, it is also not necessary to form a portion to secure the second terminal 30 by forming a protrusion from the outer surface of the sidewall 12 as in a conventional one, so that it is also possible to reduce the dimension of the housing 10 in the thickness direction of the sidewall 12. As a result, it is also possible to reduce the size of the connector 1 in the height direction and the thickness direction.

According to the embodiment, since the second elastic arm portion 32 can be made longer within height range of the sidewall 12 by extending to near the upper end of the sidewall 12, the second elastic arm portion 32 can securely have enough spring length even if the height dimension of the second elastic arm portion 32 is in the height range of the housing 10. Accordingly, since the second elastic arm portion 32 can easily elastically deform by increasing the spring length of the second elastic arm portion 32, it is easier to insert the flat conductive member P into the receiving groove 14.

In addition, according to the embodiment, since the first terminals 20 and the second terminals 30 may be attached respectively by pressing from the same direction to the sidewall 12 and the sidewall 13 of the housing 10, it is possible to easily attach the first terminals 20 and the second terminals 30 to the housing 10 and easily produce even the connector 1.

More specifically, the connector 1 is configured such that both the first terminals 20 and the second terminals 30 are attached to the housing 10 from the bottom portion thereof (in the same direction). Further, the connector 1 is configured such that both the first terminals 20 and the second terminals 30 are arranged at the same positions in the arrangement direction thereof.

Furthermore, as shown in FIG. 3(A), since the first terminals 20 as signal terminals and the second terminals 30 as ground terminals can be provided being close to each other within the housing space 15 without interposing any member therebetween, such as the housing 10, it is easy to adjust transmission characteristics of electrical signals.

Figure 5A:
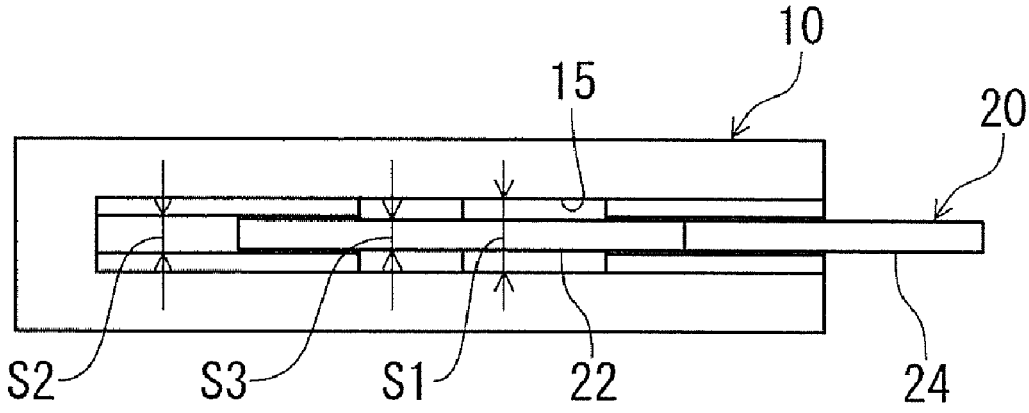
Figure 5B:
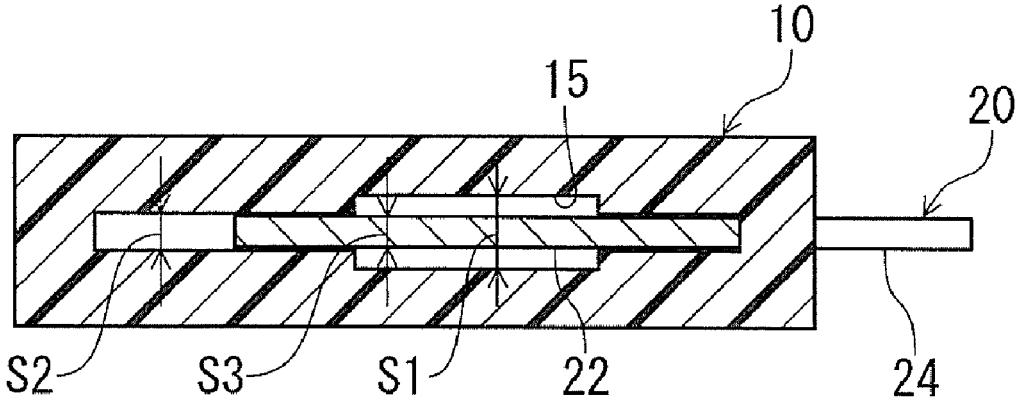

FIG. 4 is a sectional view of the connector 1 shown in FIG. 3(B), in which illustration of the first terminals 20 and the second terminals 30 is omitted. FIG. 5(A) is a bottom view of the connector 1 shown in FIG. 3(B), and FIG. 5(B) is a VB-VB sectional view of the connector 1 shown in FIG. 3(B). Here, FIGS. 5(A) and (B) are a bottom view and a sectional view taken near the first terminals 20 in the terminal arrangement direction, in which illustration of other parts is omitted.

The groove width of each generally L-shaped receiving groove 15 in the housing 10 is slightly larger than the thicknesses of the first terminals 20 and the second terminals 30 in the most part (a region R2 in FIG. 4), and there is a slight gap formed between plate surfaces of the first terminals 20 and the second terminals 30. These gaps allow the elastic displacement of the first terminals 20 and the second terminals 30 in a direction that is parallel to the plate surface, and the groove's inner wall surfaces that form each gap are designed to restrict excess displacement of the first terminals 20 and the second terminals 30 more than allowed in a direction that is orthogonal to the plate surface, i.e. the terminal arrangement direction.

Furthermore, in a partial region that houses the horizontal part of the first elastic arm portion 22 of each first terminal 20 (a region R1 in FIG. 4), there is formed a wider gap than the above-described gap of the other area (the region R2 in FIG. 4) from plate surfaces of the second terminals 30. More specifically, as shown in FIGS. 5(A) and 5(B), the groove's width S1 in the region R1 is set larger than the groove's width S2 in the region R2. In addition, the groove's width dimension S2 is set slightly larger than the plate thickness S3 of the first terminals 20.

Moreover, the region R1 includes a region that overlaps with the upper opening of the receiving groove 14 and the lower opening of the receiving groove 15, if the housing 10 is viewed from upper side. In other words, as shown in FIG. 4, the left part of the region R1 is provided right under the upper opening and right above the lower opening.

According to the embodiment, as described above, the region R1 has larger groove width than the region R2 and the gap from the plate surfaces of the first terminals 20 in the region R1 is formed large. The region R1 includes a region that overlaps with the upper opening and the lower opening. Therefore, when the pressing member 40 is at the open position shown in FIGS. 3(A) and 3(B), even if foreign matters such as dust fall and enter from the upper opening of the receiving groove 14, the dust may fall and then be discharged outside from the lower opening through the left part of the gap in the region R1.

Accordingly, according to the embodiment, since dust falls and then will be discharged from the housing 10, dust does not deposit in the receiving groove 14 and in the housing groove 15. Therefore, it is possible to satisfactorily prevent problems such as short circuit between adjacent terminals due to adhesion of the dust to the first terminals 20 and the second terminals 30.

In addition, if the first connecting section 24 of each first terminal 20 is connected by soldering to a signal circuit section on the circuit board, the solder and the flux may crawl up from the first connecting section 24 towards the first contact section 22A by a capillary phenomenon. According to the present invention, however, since the gap is formed in the region R1, such capillary phenomenon does not take place in such wide gap, and the solder and the flux does not crawl up further. As a result, it is possible to satisfactorily prevent occurrence of poor connection due to adhesion of the solder and the flux to the first contact sections 22A.

As shown in FIG. 1, the pressing member 40 is formed to have almost the same dimension as the sidewalls 11 and 12 of the housing 10 in the terminal arrangement direction, and as well shown in FIGS. 3(A) and 3(B), the pressing member 40 is provided above the sidewall 11. The pressing member 40 can pivotally move between the open position where the pressing member 40 extends in the vertical direction as shown in FIG. 1 and the close position where the pressing member 40 is generally orthogonal to the open position as shown in FIG. 2. As shown in FIGS. 3(A) and 3(B), the pressing member 40 includes slit-like grooves 41, as seen in the lower half part when it is in the open position, at the same positions as the first terminals 20 in the terminal arrangement direction.

As shown in FIGS. 3(A) and 3(B), in each groove 41, a rotary shaft 42, whose section taken orthogonally to the terminal arrangement direction is circular, and a rectangular rotary restriction section 43 are integrally formed like an island, and the facing inner wall surfaces of the groove 41 are joined by the rotary shaft 42 and the rotary restriction section 43. The rotary shaft 42 is freely rotatably supported by the rotary support section 23A of the first terminal 20, and works as a rotary shaft of the pressing member 40.

Figure 6B:
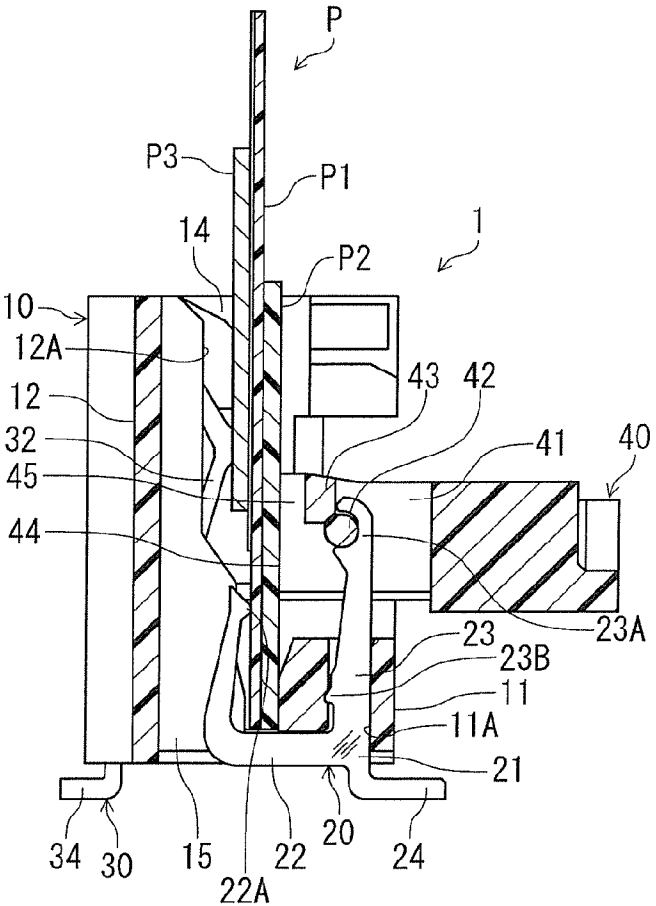
Figure 6A:
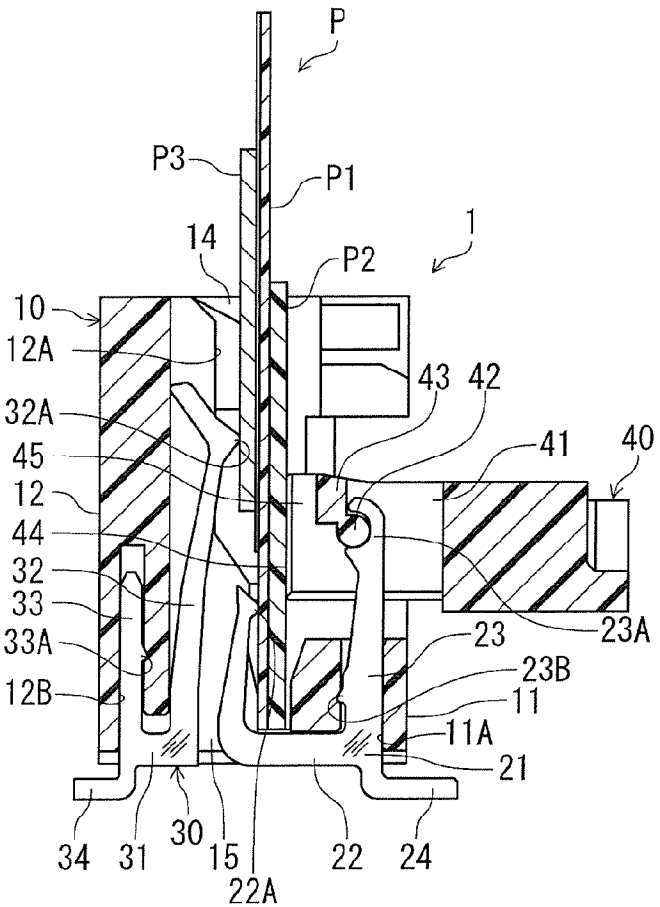

In addition, the rotary restriction section 43 contacts with a tip of the rotary support section 23A at the close position when the pressing member 40 moves from the open position to the close position (see FIGS. 6(A) and 6(B)). As a result, further rotary movement of the pressing member 40 is restricted and the pressing member 40 is kept at the close position.

As will be described later, the lower end part of the pressing member 40 at the open position shown in FIGS. 3(A) and 3(B) protrudes into the receiving groove 14 at the close position and is formed as the pressing section 44, which presses the flat conductive member P towards the first contact sections 22A of the first terminals 20 and the second contact sections 32A of the second terminals 30 (see FIGS. 6(A) and 6(B)).

As will be described later, the groove part provided lower than the rotary restriction section 43 of the pressing section 44 at the open position when the pressing member 40 is at the open position forms a communicating groove 45, which is in the receiving groove 14 and goes through in the vertical direction when the pressing member 40 moves to the close position. At the close position, the communicating groove 45 connects between the receiving groove 14 and the housing groove 15 in the vertical direction (see FIGS. 6(A) and 6(B)).

As well shown in FIG. 2, when the pressing member 40 is at the close position, there are formed lock-in sections 46, which are linear protrusions that extend in the facing direction of the sidewalls 11 and 12 at the both ends of the pressing member 40. As shown in FIG. 1, the lock-in sections 46 are designed to lock into the locking section 51 of the locking hardware 50, which will be described later.

The locking hardware 50 is made by punching sheet metal and then bending in the plate thickness direction. As shown in FIGS. 1 and 2, the locking hardware 50 includes an attaching section (not illustrated) that is to be attached and extends in the vertical direction, and a locking section 51, which is bent so as to protrude towards inside the connector in the terminal arrangement direction.

In the embodiment of the present invention, the locking hardware 50 is attached into the recess 16 by pressing the attaching section into the locking hardware attachment hole (not illustrated), which is formed at a bottom of the recess 16 of the housing 10, from above. Then, when the pressing member 40 is at the open position shown in FIG. 1, the locking section 51 keeps the pressing member 40 at the open position by locking to the lock-in sections 46, which are formed at the both ends of the pressing member 40.

FIGS. 6(A) and 6(B) are longitudinal sectional views showing the circuit board electrical connector after the flat conductive member is inserted into the circuit board electrical connector according to the embodiment of the present invention. More specifically, FIG. 6(A) is a sectional view of the circuit board electrical connector corresponding to FIG. 3(A) and FIG. 6(B) is a sectional view of the circuit board electrical connector corresponding to FIG. 3(B). Hereunder, referring to FIGS. 3(A) and 3(B) and FIGS. 6(A) and 6(B), connection between the connector 1 and the flat conductive member P will be described.

First, with the pressing member 40 being at the open position shown in FIGS. 3(A) and 3(B), insert the flat conductive member P into the receiving groove 14 from above. Once the flat conductive member P is inserted in the receiving groove 14, a surface of the flat conductive member P (a surface on the left side in FIG. 6(A)), on which a signal circuit section and the ground bar P3 are formed, faces the first contact sections 22A of the first terminals 20 and the second contact sections 32A of the second terminals 30.

Next, pivotally move the pressing member 40 at the open position to the close position shown in FIGS. 6(A) and 6(B). At the close position, the pressing section 44 of the pressing member 40 protrudes into the receiving groove 14, and presses the flat conductive member P to the first contact sections 22A of the first terminals 20 and the second terminals 32A of the second terminals 30A. As a result, the contact pressure between the first contact sections 22A and the signal circuit section and the contact pressure between the second contact sections 32A and the ground bar P3 are enhanced.

According to the embodiment, since the second elastic arm portion 32 of each second terminal 30 is held like a cantilever in its free state, if the pressing member 40 pivotally moves to the close position after insertion of the flat conductive member P and thereby the ground bar P3 presses the second contact section 32A, the whole second elastic arm portion 32 itself easily elastically displaces leftward.

Then, once the elastic displacement reaches specific amount, as shown in FIG. 6(A), the upper end of each second elastic arm portion 32 contacts with an inner wall surface of the sidewall 12 and becomes held at the both end, so that it hardly elastically displaces in comparison with when it is held like a cantilever. As a result, since excess elastic displacement of the second elastic arm portion 32 becomes restricted, it is possible to prevent damages (permanent setting in fatigue) of each second elastic arm portion 32 and to achieve high contact pressure between the second contact section 32A and the ground bar P3.

At the close position, as shown in FIGS. 6(A) and 6(B), the communicating groove 45 of the pressing member 40 is located in the receiving groove 14, and the receiving groove 15 and the housing groove 15 communicate to each other in the vertical direction via the communicating groove 45. Accordingly, even if foreign matters, such as dust, fall and enter from the upper opening of the receiving groove 14, such dust falls and then will be discharged outside from the lower opening through the communicating groove 45 and the gap in the housing groove 15.

As a result, the dust does not deposit in the receiving groove 14 or in the housing groove 15. Therefore, it is possible to satisfactorily prevent problems such as short circuit between adjacent terminals due to adhesion of the dust onto the first terminals 20 and the second terminals 30. In addition, it is also possible to satisfactorily prevent poor connection to the flat conductive member P due to adhesion of the dust to the first contact sections 22A of the first terminals 20 and the second contact sections 32A of the second terminals 30.

In the embodiment, the first terminals and the second terminals are made by punching sheet metal, whereas it is also possible to make at least the first terminals or the second terminals by bending strip-like sheet metal in the plate thickness direction.

The disclosure of Japanese Patent Application No. 2010-022086, filed on Feb. 3, 2010 is incorporated in the application by reference.

While the invention has been explained with reference to the specific embodiments of the invention, the explanation is illustrative and the invention is limited only by the appended claims.

What is claimed is:

1. An electrical connector to be mounted on a circuit board, comprising:

a housing including an upper opening portion, a receiving space for receiving a flat conductive member through the upper opening portion, a lower opening portion, and a housing space communicating with the receiving space; and a terminal arranged in the housing and inserted into the housing space through the lower opening portion, said terminal including a base section fitted in the housing, a connecting section to be connected to the circuit board at one end portion thereof on a side of the lower opening portion, a contact section for contacting with the flat conductive member at the other end portion thereof, and a middle section between the base section and the contact section, wherein said housing space has a first groove portion for receiving the middle section and a second groove portion for receiving the base section, said first groove portion having a width greater than that of the second groove portion in a direction perpendicular to a longitudinal direction of the terminal.

2. The electrical connector according to claim 1, wherein said housing space is arranged to connect the upper opening portion and the lower opening portion.

3. The electrical connector according to claim 1, further comprising a pressing member to be rotatable between an open position so that the flat conductive member is inserted into the receiving space and a close position so that the pressing member presses the flat conductive member against the contact section.

4. The electrical connector according to claim 3, wherein said pressing member includes a pressing section situated in the receiving space for pressing the flat conductive member against the contact section when the pressing member is at the close position.

5. The electrical connector according to claim 4, wherein said pressing section includes, a communicating groove vertically connecting the receiving space and the housing space when the pressing member is at the close position so that a dust is discharged from the lower opening portion through the communicating groove.

* * * * *